United States Patent [19]

Kumpulainen

[11] 4,026,594

[45] May 31, 1977

[54] CONNECTING DEVICE

[76] Inventor: Kauko Kumpulainen, Hushagsgatan 13 H, 781 02 Borlange, Sweden

[22] Filed: Mar. 4, 1976

[21] Appl. No.: 663,698

[30] Foreign Application Priority Data

Mar. 14, 1975 Sweden ..... 7502876

[52] U.S. Cl. ..... 294/83 R; 294/110 R

[51] Int. Cl.[2] ..... B66C 1/38

[58] Field of Search ..... 294/66 R, 75, 83 R, 294/83 A, 83 AB, 84, 110 R; 24/230.5 AC, 232 R, 232 G, 241 P, 241 TC, 242

[56] References Cited

UNITED STATES PATENTS

| | | | |
|---|---|---|---|
| 2,085,012 | 6/1937 | Dixon | 294/83 R |
| 2,476,734 | 7/1949 | Jellison | 294/110 R X |
| 3,031,222 | 4/1962 | Stewart | 294/110 R |
| 3,311,401 | 3/1967 | Bacon | 294/110 R X |
| 3,428,356 | 2/1969 | Anderson | 294/110 R |
| 3,539,217 | 11/1970 | Szekely | 294/83 A |
| 3,600,031 | 8/1971 | Coleman et al. | 294/110 R X |

*Primary Examiner*—Johnny D. Cherry
*Attorney, Agent, or Firm*—Browdy and Neimark

[57] ABSTRACT

A device for connecting and disconnecting a lifting or drawing hook to and from respectively a couple. The hook has a passage for the couple located close to the free end portion of the hook and is rotatable between a position for releasing and/or receiving the couple, in which the passage is directed in a first direction relative to the axis of rotation of the hook, and a position for grabbing the couple, in which the passage is directed in a second direction diverging from the first direction. The hook has a locking means co-operating with an operating means located at the passage, the locking means being, on one hand, arranged to move from a locking position by the influence of the operating means in connection with the entry of the couple through the passage, thus allowing the hook to be rotated to the position in which it grabs the couple. On the other hand, the locking means is arranged to adopt the locking position as soon as the hook is rotated to the position for releasing the couple and the couple is out of engagement with the hook, thus retaining the hook in the releasing and/or receiving position with the passage directed in the above-mentioned first direction relative to the axis of rotation.

12 Claims, 4 Drawing Figures

CONNECTING DEVICE

BACKGROUND OF THE INVENTION

This invention relates to a device for connecting and disconnecting a lifting or drawing hook to and from a couple.

In connecting lifting or drawing hooks to couples of different types it has hithertofore been necessary to provide a special operator who effects the engagement the hook with the couple. This known technique is costly as well as ineffective as to the exploitation of the labor. Moreover, the special operator is often subjected to unsafe conditions. Thus, accidents or the threat of accidents occur from time to time which can cause considerable disabilities for the operator. Usually it is a question of fingers or hands getting pinched between the hook and the couple; an operators finger and hands can be injured or even completely severed. At times injuries to other parts of the body may occur as a result of the fact that the operator stays within the range of movement of the hook where he can be hit by hooks movng in an uncontrolled manner.

SUMMARY OF THE INVENTION

It is an object of the present invention to provide a connecting device which avoids the need for a special operator for the connecting work and which eliminates the above-mentioned shortcomings and disadvantages.

The device according to the invention comprises a hook having a passage for the couple located close to the free end portion of the hook and being rotatable between a position for releasing and/or receiving the couple, in which the passage is directed in a first direction relative to the axis of rotation of the hook, and a position for grabbing the couple, in which the passage is directed in a second direction diverging from the first direction. Characterizing for the inventive device is that the hook has a locking means co-operating with an operating means located at the passage, said locking means being on one hand disposed to move from a locking position by the influence of the operating means in connection with the entry of the couple through the passage, thus allowing the hook to be rotated to the position in which it grabs the couple, and on the other hand disposed to adopt the locking position as soon as the hook is rotated to the position for releasing the couple and the couple is out of engagement with the hook, thus retaining the hook in the releasing and/or receiving position with the passage directed in the above mentioned first direction relative to the axis of rotation.

When lifting or drawing hooks and couple respectively are mentioned in connection with the invention, these terms should be understood in their most extensive sense. Thus, the couple can be an arbitrary element whatsoever, on which the hook can be hooked. In the conventional manner, it can be the question of an eye, a ring, a hook or the like, as it may also be the question of couples more specifically shaped, such as straight or bent rods, tubes, wires, chains, cables and so on. Also the hook can be of an arbitrary type and be shaped in multifarious ways as long as it is capable of being hooked on the couple in question.

DESCRIPTION OF THE PREFERRED EMBODIMENT

Figure 1:
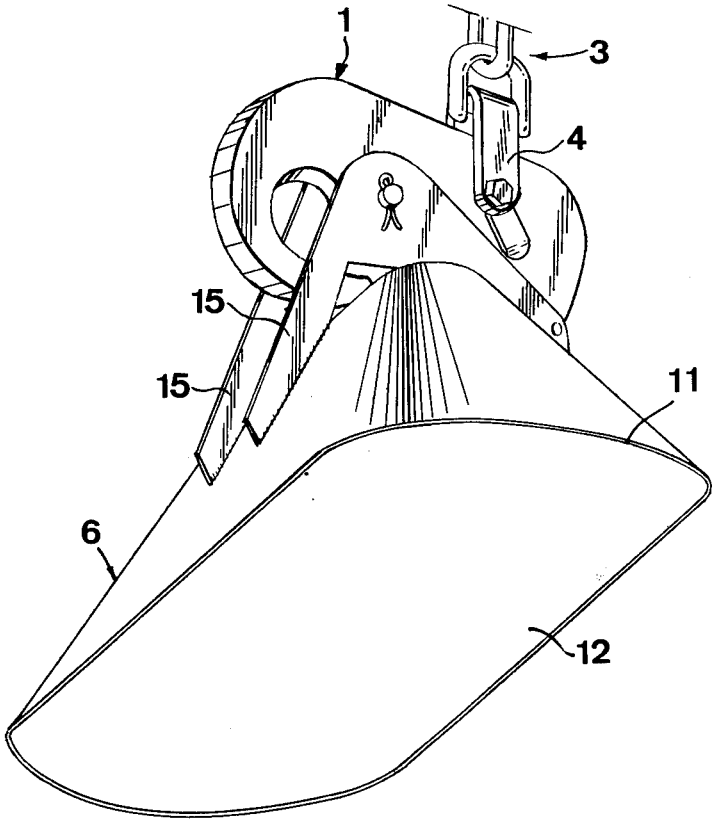
FIG. 1 is a perspective view of an exemplary device according to the present invention being lowered onto a lift eye for connecting this eye and a lifting hook, the device being viewed obliquely from below.
Figure 1:
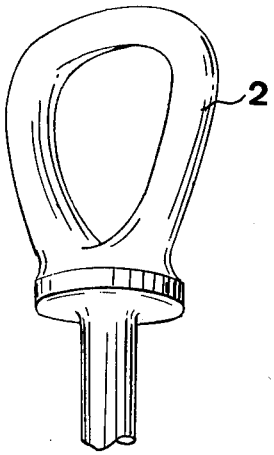

In the drawings, 1 designates as a whole a lifting hook to be connected to a couple in the shape of an eye or ring designated 2. In practice, the couple 2 is disposed upright so that the hook 1 can grab the couple laterally through the opening in the couple. The couple 2 can be attached to any arbitrary object whatsoever to be lifted, for example engineering products, motors, engines, boxes or other packings, articles of wood, vehicles and so on. A pulling element of an appropriate type is attached to the hook 1; in the case illustrated, the pulling element is a chain 3 having a shackle 4. Instead of a chain, it is of course also conceivable to use other pulling elements, such as ropes, wires, cables, rods or the like.

The hook 1 is rotatable on a shaft 5, which is mounted in or secured to a guide means for the couple 2, said guide means being generally designated by the numeral 6. As appears from FIGS. 2 and 4, the hook 1 has a passage 8, which is located close to the free end portion 7 of the hook 1 and through which the couple 2 has to pass in moving into and out of engagement with the hook. The hook 1 is rotatable between a position (FIGS. 1 and 3) for releasing and/or receiving the couple 2, in which position the passage 8 is directed in a first direction relative to the axis of rotation 5 of the hook, and a position (FIG. 2 and 4) for grabbing the couple 2, in which position the passage 8 is directed in a second direction diverging from the first direction. Further, the hook has, in accordance with the inventive concept, a locking means 10 co-operating with an operating means 9 located at the passage 8, the locking means being on one hand arranged to move from a locking position by the influence of the operating means 9 in connection with the entry of the couple through the passage, thus allowing the hook to be rotated to the position in which it grabs the couple, and on the other hand arranged to adopt the locking position as soon as the hook is rotated to the position for releasing the couple and the couple is out of engagement with the hook, thus retaining the hook in the releasing and/or receiving position with the passage directed in the above-mentioned first direction relative to the axis of rotation.

Figure 2:
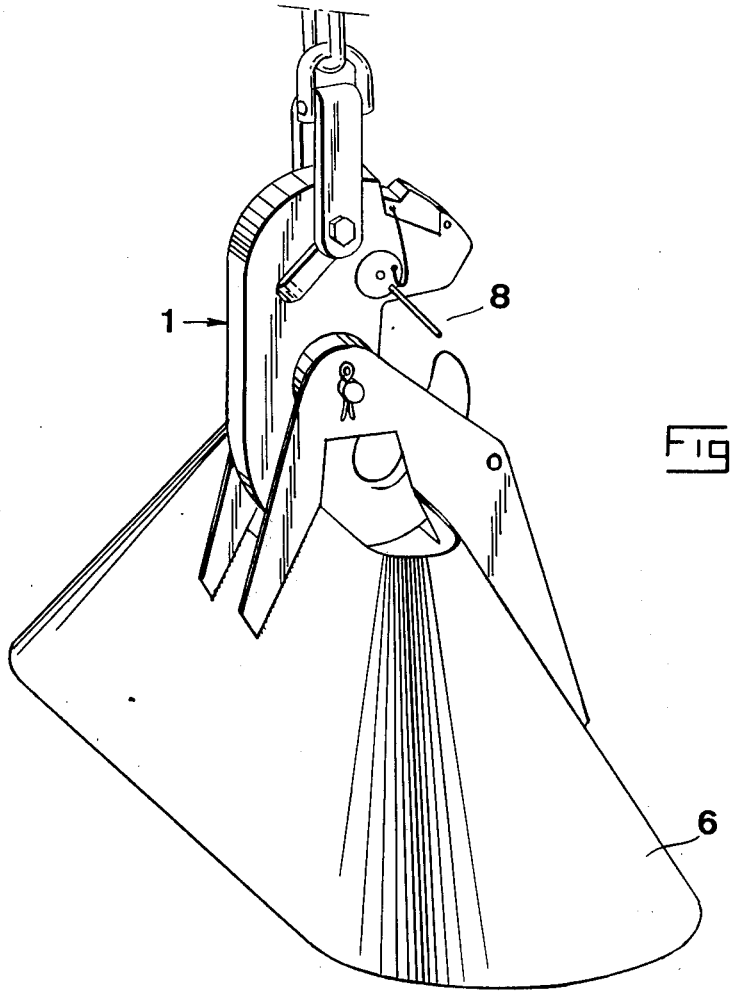
FIG. 2 is a perspective view of the device viewed obliquely from above and from the opposite direction, the lifting hook being in a position for grabbing the couple or lift eye.
Figure 3:
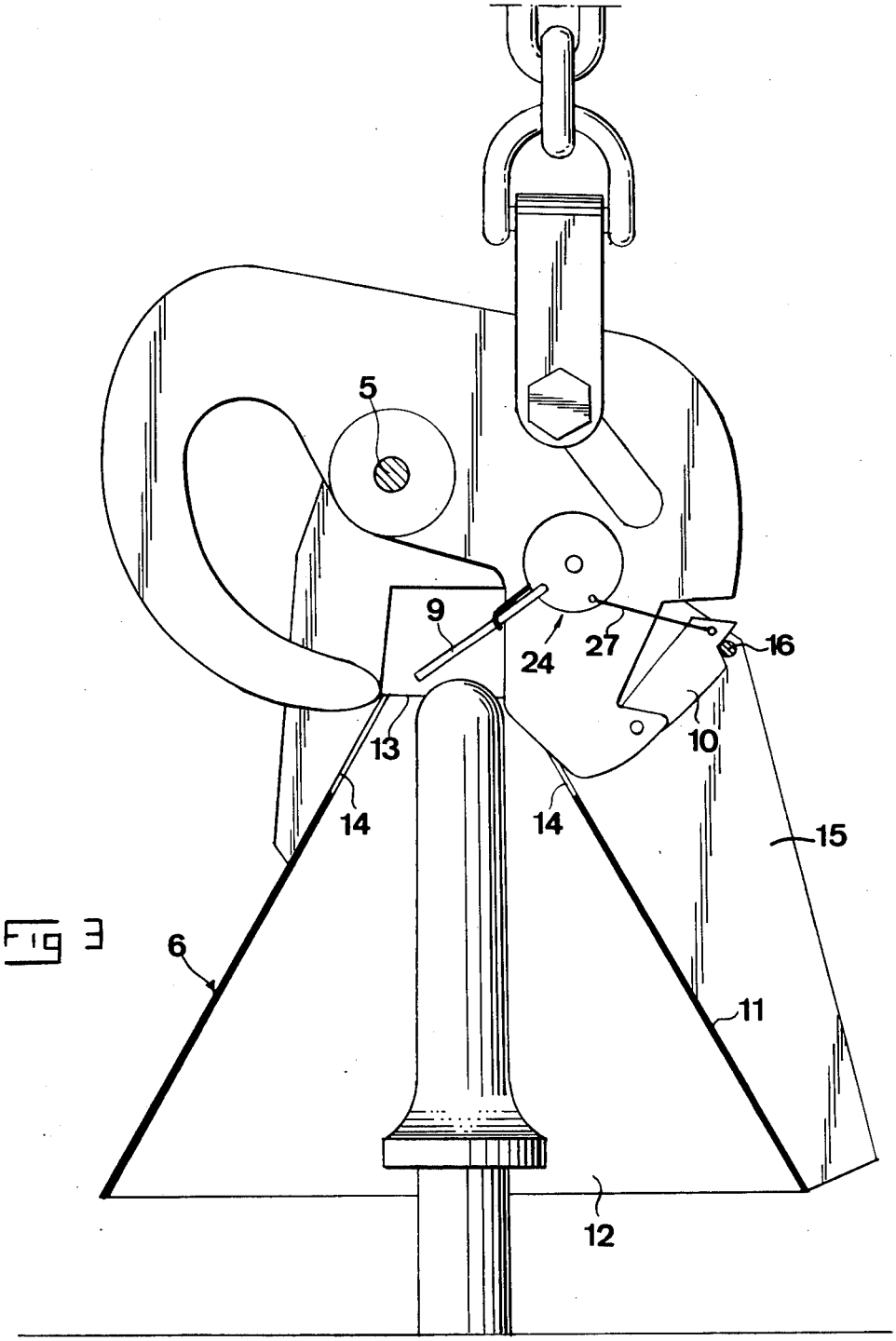
FIG. 3 is a side view, partially in section, of the device with the lifting hook in the same position as in FIG. 1.
Figure 4:
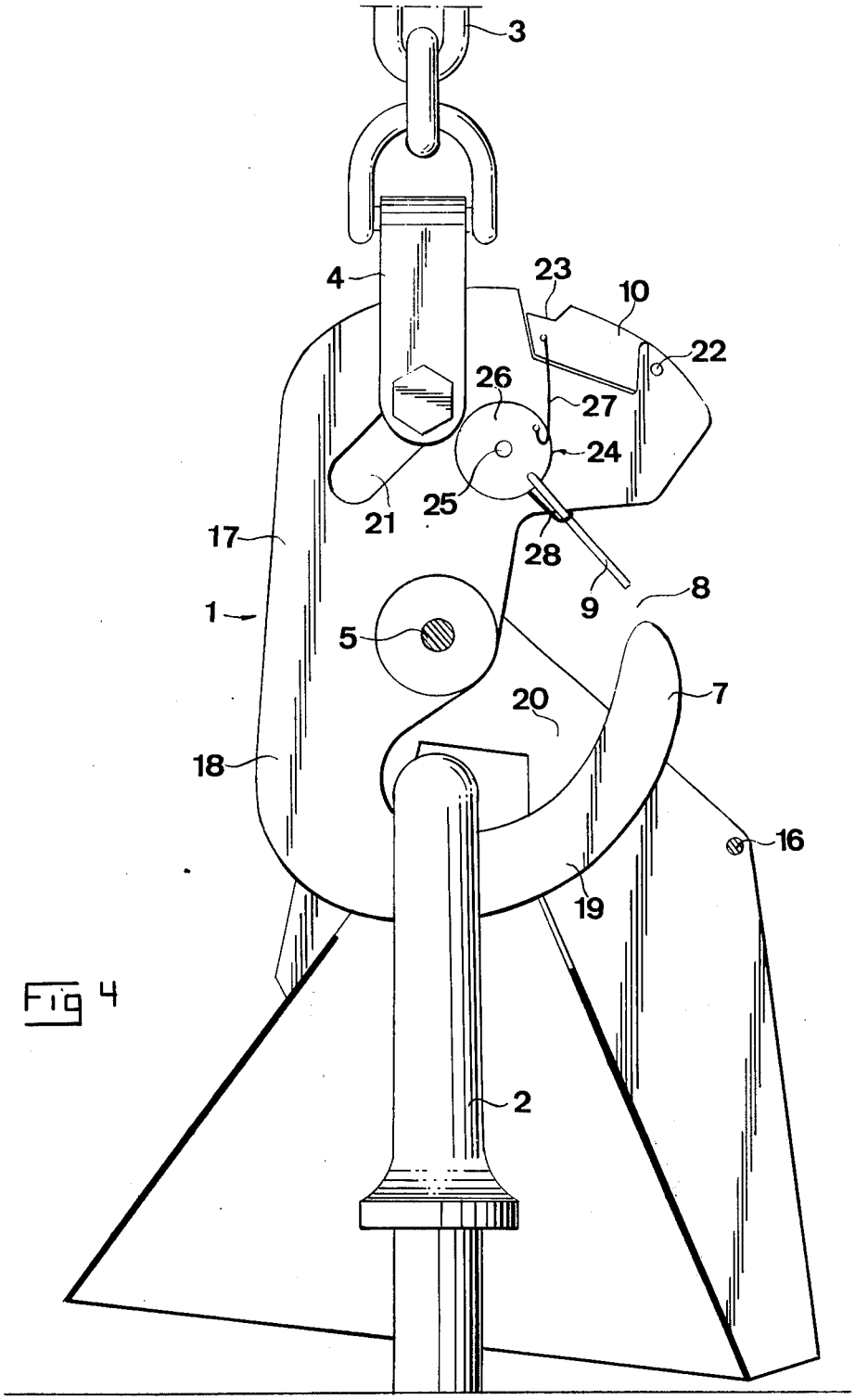
FIG. 4 is a side view, partially in section, of the device with the lifting hook in the same position as in FIG. 2.

Since the hook 1 in this case is a lifting hook operating substantially vertically, the hook in question is located in substantially upright position when it grabs the couple 2 (FIGS. 2 and 4). In the position in which the couple 2 is released and/or received, the hook 1 is on the other hand located substantially horizontally, i.e.

essentially perpendicular to the grabbing position (FIGS. 1 and 3).

The above mentioned guiding means 6 is disposed to guide compulsorily the couple 2 towards the passage 8 located in said first direction relative to the axis of rotation upon approach of the couple and the hook 1 to each other. In the exemplified embodiment, the guiding means 6 comprises a funnel or collar-like narrowing case 11 having two opposite openings 12, 13, the first, free opening 12 of which is considerably wider than the second opening 13 across which the hook 1 is rotatable to and fro. It should be observed that on opposite sides of the second opening 13, two slots 14 are recessed in the side plates of the case 11. The purpose of these slots 14 is to contain the hook 1 when it is in the grabbing position. The ratio between the areas of the two openings 12 and 13 can vary considerably, but as a minimum, the area of the opening 12 preferably should be substantially five times larger than the area of the opening 13. In practice, the ratio can be greater than 10:1.

As appears best from FIG. 1, the case 11 has, speaking generally, a rectangular shape in an arbitrary cross section between the two openings 12, 13 apart from the bevelled corners between the longside walls and the gable walls. This rectangular or oblong cross section shape of the case 11 owes its shape to the plane cross section shape of the particular couple 2 to be guided through the upper opening 13 in the case. By the shape of the case 11 it is guaranteed that the couple 2 is always guided correctly into the upper opening 13 irrespective of the relative position of the couple at the beginning of its guiding by the case 11.

Two spaced apart back parts 15 are rigidly secured to the case 11, these back parts spanning the upper opening 13 and presenting attachments, bushings or bushing holes for the shaft 5 on which the hook 1 is rotatable. The back parts 15 can advantageously be welded to the case 11. In addition, a fixed pin 16 extends between the back parts 15, the pin being a stop for the locking means 10 as will be described more detailed hereinafter. The hook 1, as shown in FIG. 4, includes an upper portion 17 above the shaft 5 and a lower portion 18 below the same shaft, the lower portion including a proper hook portion 19 of the hook 1 (this hook portion 19 is spaced from the remaining hook body by a curved space 20 which is outwardly terminated by the passage 8). According to the invention the upper portion 17 has a greater mass than the lower portion 18. The effect of this is that the hook 1, as soon as the tensile stress in the chain 3 ceases, by the force of gravity automatically endeavors to rotate to a position turned down from the grabbing position. In order to enable the hook 1 to rotate in the appropriate direction in this connection and adopt the position shown in FIG. 3, suitable spring means can be provided, for example a spring associated with the shaft 5, this spring always biasing the hook 1 in a clockwise direction according to FIGS. 3 and 4.

From FIG. 4 it further appears that the shackle 4 with its transverse bolt is positioned in an elongated, oblong hole 21. More particularly, the hole 21 extends from a first point located substantially vertically above the rotary shaft 5 of the lifting hook 1 in the grabbing position shown in FIG. 4 to a second point located below the first point and displaced laterally in the direction away from the passage 8. The point of action of the pull element 3 can always be the best one irrespective of the position of rotation of the hook 1 because of the oblong nature of the hole 21. Thus, the point of action of the pulling element 3 in the grabbing position shown in FIG. 4 is located substantially aligned above the shaft 5 and the couple 2. In the releasing and receiving position respectively shown in FIG. 3, the point of action of the pulling element 3 is displaced in such a way that the funnel shaped guiding means 6 is carried with its lower opening 12 located substantially horizontally.

In this case the locking means mentioned above consists of a locking body 10 movable relative to the hook 1 and disposed to adopt a locking position in engagement with the pin 16 serving as a stop as soon as the lifting hook is turned to the position wherein the couple 2 is released. More particularly, the locking body 10 is rotatably connected to the hook 1 by a shaft 22 and is movable between a position turned outwardly from the hook in which the body engages the stop pin 16 and a position turned inwardly towards the hook in which the body is free of the stop pin. In the embodiment shown the locking pin 10 is fitted in a recess in the body of the hook 1. It should be observed that the shape of the outside of the locking body 10, except for a countersunk portion 23 receiving the stop pin 16, is adapted to the curved shape of the hook itself. The movement of the locking body 10 to the turned-out locking position is effected by the own weight of the body which automatically moves the body out as soon as the hook 1 adopts the position shown in FIG. 3. The movement of the locking body 10 to the turned-out position may however also be provided in another manner, for example by means of a compression spring (not shown) acting against the inside of the locking body. The movement of the locking body 10 inwardly towards the hook 1, out of engagement with the stop pin 16, is effected by the operating means 9 which in this case consists of a finger extending across the passage 8, the finger being in connection with the locking body by a transmission generally designated by the numeral 24. In the simple example shown, this transmission consists of a circular plate 26 pivotally disposed on a journal 25, the finger 9 being attached to the plate 26. At a distance from the journal 25 one end of a flexible element 27, e.g. a thin line, is attached, the opposite end thereof being attached to the locking body 10, more particularly at the end of the locking body being opposite to the shaft 22. The finger 9 is connected to a spring 28 anchored relative to the hook 1, the spring always endeavoring to bring the finger back to the initial position shown in FIG. 4 across the passage 8 independently of whether the finger has moved clockwise or counterclockwise.

The device described operates in the following manner. In a condition when the device is prepared to be connected to the couple 2, the hook 1 adopts the position shown in FIGS. 1 and 3 relative to the guiding means 6. The device in its entirety is carried by the pulling element 3. The locking body 10 engages the stop 16 and the line 27 between the locking body and the finger 9 is stretched, though not stressed. In this condition, the passage 8 of the hook 1 is directed downwardly from the shaft 5 and located at the upper opening 13 of the guiding case 11. When the device is lowered over the couple 2, the couple is guided upwardly through the funnel shaped case 11 up to the passage 8. From now on, the following happens in quick succession. The finger 9 is turned upwardly in the direction towards the shaft 5, the movement of the finger being transmitted through the transmission 24 to the locking body 10 which is turned inwardly towards the hook 1 and moves out of its locking engagement with the stop 16. The hook 1 is now free to rotate on the shaft 5 and by the tractive force in the pulling element 3, a rotation of the hook 1 is now performed from the position shown in FIG. 3 to the position shown in FIG. 4, where the hook is substantially upright with the passage 8 directed laterally from the shaft. On this occasion the proper hook portion 19 grabs the couple 2 and the couple including the attached load can now be lifted. The connection is now finished.

In conjunction with the connection procedure described above, it should be observed that the couple 2 during the period in which the hook 1 adopts the position shown in FIG. 3 is, due to the guiding case 11, compulsorily guided in a substantially vertical course guaranteeing that the finger 9 is actuated by the couple 2 under all circumstances. Thus the couple 2 cannot move laterally and the relative movement between the hook 1 and the couple 2 is attended to by the hook alone.

On disconnecting the couple 2 the following happens. When the load, together with the attached couple 2 is put down, the tractive force in the pulling element 3 ceases and the lifting hook 1 is, owing to the greater mass of the upper portion 17 in relation to the lower portion 18, rotated from the upright position shown in FIG. 4 towards the substantially horizontal position shown in FIG. 3. This rotation can advantageously be guided by means of a previously mentioned spring, not shown, which causes the hook 1 to rotate in a correct direction. As soon as the hook 1 is turned down to the horizontal position, the locking body 10 becomes engaged with the pin 16 and the hook 1 is now locked in this position. When the hook is turned to the horizontal position according to FIG. 3, the proper hook portion 19 leaves the couple 2 and the couple is localized with respect to the passage 8 and the finger 9. When the hook is lifted over again in order to leave the couple completely, the couple will influence the finger 9. This influence does not, however, mean that the locking body 10 loses its locking engagement with the pin 16, since the finger 9 is now rotated in a direction from the shaft 5; a fact that merely implies that the line 27 is slacked. Accordingly, the hook 1 can be removed from the couple 2 without being displaced out of its position shown in FIG. 3 relative to the guiding means 6. Thus, the device is immediately prepared to receive another couple 2 for connecting thereof to the hook 1.

From the above it should appear that the connection as well as disconnection of the couple 2 to and from the hook 1 respectively can be performed quite automatically without the need of any special operator being present.

Of course, the device described and shown in the drawings does not constitute the sole embodiment realizing the invention. Thus, within the scope of the invention, it is conceivable to have two or more lifting hooks co-operating for connection to a couple, for instance in the shape of a rod or another elongated object. The hook can be designed in multifarious other manners, for instance it may be provided with two or more proper hook portions. The locking body 10 can be differently than the one shown whether it is operated by means of the force of gravity as exemplified or by means of springs, it being conceivable to modify the transmission 24 as well as the operating means, which as illustrated as the finger 9. Also the shape and performance of the guiding means 6 can be changed in many ways in order to fit different types of couples. Though the inventive device has been exemplified in connection with a lifting hook, it is self-evident that the invention is also applicable in connection with for instance drawing hooks operating in a direction diverging from the vertical direction.

What I claim is:

1. In a device for connecting and disconnecting a lifting or drawing hook having an axis of rotation to and from a couple, the hook having a free end portion and a passage for the couple located close to the free end portion and being rotatable between a first position for releasing and receiving the couple, in which the passage is directed in a first direction relative to the axis of rotation of the hook, and a second position for grabbing the couple, in which the passage is directed in a second direction diverging from the first direction, the improvement comprising a chain means or the like carrying said hook; an operating means including a member located at the passage; locking means controllably coupled to said operating means and movable from a locking position by said operating means in response to entry of the couple through the passage and into contact with said member for allowing the hook to be rotated to the second position in which it grabs the couple and constitutes the sole force-transmitting element between the chain means and the couple, said locking means being movable to the locking position upon rotation of the hook to a position for releasing said couple out of engagement with said hook and into the first position and for placing said locking means in the locking position with the passage directed in the first direction relative to the axis of rotation.

2. An improved device according to claim 1, wherein said hook is rotatably connected to a guiding means for guiding said couple towards said passage located in the first direction relative to the axis of rotation.

3. An improved device according to claim 2, wherein said guiding means comprises a funnel or collar-like narrowing case having two opposite free openings, one of said openings being an opening which is considerably wider than the other of said openings and more distant from said hook than said other opening.

4. An improved device according to claim 3, wherein the case has an oblong or substantially rectangular shape in arbitrary cross sections between said two openings.

5. An improved device according to claim 3, wherein two spaced-apart back parts are united with said case, said back parts spanning said other opening and including support means, a shaft extending between said back parts and supported by said support means, said hook being rotatable on said shaft.

6. An improved device according to claim 2, wherein said locking means is arranged for engagement with a stop fixed on said guiding means.

7. An improved device according to claim 6, wherein said stop is a pin placed between two spaced-apart back parts united with said guiding means.

8. An improved device according to claim 6, wherein said locking means comprises a locking body movable relative to said hook and disposed to adopt a locking position in engagement with said stop as soon as said hook is rotated to the first position in which the couple is released and/or received.

9. An improved device according to claim 8, wherein said locking body is pivotally connected to said hook by a shaft, within a recess in said hook, and movable between a position turned outwardly from said hook, wherein said body engages and locks against said stop, and a position turned inwardly towards said hook wherein said body is free of contact with said stop.

10. An improved device according to claim 1, wherein said hook is a lifting hook operating substantially vertically and being rotatable between a substantially upright grabbing position and a releasing and/or receiving position substantially perpendicular to the grabbing position.

11. An improved device according to claim 10, wherein said lifting hook has an upper portion and a lower portion, said upper portion being above the axis of rotation in the grabbing position and having a greater mass than said lower portion, said lower portion being below the axis and constituting a hook portion proper, whereby the lifting hook in an unloaded condition is, by force of gravity, automatically brought to a position in which the upper portion is located at least substantially horizontally outwardly from the axis of rotation.

12. An improved device according to claim 1, wherein said member of said operating means comprises a finger extending across said passage and connected to said locking means via a transmission, said finger moving upon and in response to the passing of said couple through said passage and signalling, via said transmission, detected movement to said locking means for releasing said locking body from engagement with said stop.

* * * * *